United States Patent [19]

Oberdorf

[11] Patent Number: 4,484,432

[45] Date of Patent: Nov. 27, 1984

[54] BOTTOM-FOLDING PACKAGING MACHINE

[75] Inventor: Manfred Oberdorf, Gevelsberg, Fed. Rep. of Germany

[73] Assignee: Maschinenfabrik Alfred Schmermund GmbH & Co., Gevelsberg, Fed. Rep. of Germany

[21] Appl. No.: 327,496

[22] Filed: Dec. 4, 1981

[30] Foreign Application Priority Data

Dec. 6, 1980 [DE] Fed. Rep. of Germany ..... 3046065

[51] Int. Cl.[3] ..... B65B 19/24

[52] U.S. Cl. ..... 53/575; 53/234; 53/236; 53/253; 53/388; 493/247

[58] Field of Search ..... 53/148, 234, 236, 253, 53/387, 388, 563, 575; 493/247, 164, 472

[56] References Cited

U.S. PATENT DOCUMENTS

| | | | |
|---|---|---|---|
| 3,236,026 | 2/1966 | Evans | 53/387 |
| 3,590,556 | 7/1971 | Focke | 53/575 X |
| 3,608,270 | 9/1971 | Rudszinat | 53/575 X |
| 3,802,325 | 4/1974 | Bardenhagen | 53/148 X |
| 3,910,012 | 10/1975 | Schmermind | 53/234 |
| 3,956,870 | 5/1976 | Kruse | 53/234 X |
| 4,028,866 | 6/1977 | Langen | 53/575 |
| 4,150,520 | 4/1979 | Palmieri | 53/234 X |
| 4,179,864 | 12/1979 | Focke | 53/388 |
| 4,241,564 | 12/1980 | Qvazenghi | 53/575 |

FOREIGN PATENT DOCUMENTS

| | | | |
|---|---|---|---|
| WO80/00246 | 2/1980 | PCT Int'l Appl. | 53/575 |

*Primary Examiner*—John Sipos

[57] ABSTRACT

Apparatus for packaging cigarettes, the apparatus comprising means for applying a strip of packaging material about a group of the articles to form a tube and folding and gluing the ends of the wrapper to define the package is provided with a plural stage drying apparatus which permits a long glue drying operation without adversely effecting the speed of operation of the packaging apparatus. The drying apparatus includes a pair of adjacent, synchronously rotated, drums which have receiving cells for the packages. The packages are transferred, typically in pairs, into individual cells of a first drum and are subsequently simultaneously transferred from cells in the first drum into cells of the second drum.

12 Claims, 4 Drawing Figures

BOTTOM-FOLDING PACKAGING MACHINE

BACKGROUND OF THE INVENTION (1) Field of the Invention

The present invention relates to the packaging of plural articles and particularly to the formation of a soft wrapper around a pre-formed grouping of articles such as, for example, a block of cigarettes. More specifically, this invention is directed to apparatus for packaging cigarettes or the like and especially to multi-stage devices for drying the glue employed to hold the folded ends of the packages formed by such apparatus in the closed state. Accordingly, the general objects of the present invention are to provide novel and improved methods and apparatus of such character.

(2) Description of the Prior Art

While not limited thereto in its utility, the present invention is particularly well suited for use in machines for packaging cigarettes. Such packaging machines form a paper wrapper around the sides of a pre-formed block of cigarettes and subsequently, in successive steps, form the opposite ends of the package by folding and gluing the wrapper. These packaging machines include a drying drum into which the packages are transferred and retained until the glue applied to the end folds has set. In the prior art these drying drums have been of single-row construction and the newly formed packages have been inserted singly into the cells of the drying drum from the apparatus which has formed the second package end. In order to prolong the drying time, it has been proposed to employ a drying drum which includes a greater number of receiving cells than does a cooperating drum of the second end forming device. This arrangement permits the packages to remain in the drying stage for two revolutions of the drum but imposes a limitation on packaging speed since it is only possible to transfer the packages from the second end forming device into the cells of the drying drum singly. Thus, attempts to increase packaging speed necessarily result in a reduction in drying time since the drying drum must move in sequence with the end forming device.

It has also been proposed to alleviate the above-discussed problem by direct heating of the cells of the drying drum. This, however, increases the complexity of the apparatus and thus increases its cost while reducing its reliability.

SUMMARY OF THE INVENTION

The present invention overcomes the above-discussed and other deficiences and disadvantages of the prior art by providing a novel and improved technique for enhancing the drying time of packages formed in apparatus which folds and glues an opposite end or ends of a wrapper. The present invention also encompasses apparatus for use in the practice of this novel process. Thus, apparatus in accordance with the present invention comprises a packaging machine which provides for a long drying time while allowing the high speed formation of the packages which are subsequently subjected to the drying operation.

In accordance with a preferred embodiment of the present invention, a cigarette packaging machine includes a series of rotatable cell-containing drums which are axially and radially offset with respect to one another so that, as the packages are formed, they may be transferred from stage to stage by axial alignment of cells of a first stage with cells of a subsequent stage. The packaging machine includes a wrapping drum wherein the cells are in the form of hollow mandrels. While positioned on the wrapping drum, a wrapper is formed about the cigarette blocks and a first end of the wrapper is folded and glued closed. The partially formed packages are transferred from the wrapping drum into cells of a top closing drum and, while supported on the top closing drum, the second ends of the packages are folded and glued. The packages are then transferred, from the top closing drum, to the drying apparatus of the present invention. The packaging machinery briefly described above further comprises a step drive for rotating the drums of the various stages such that the drums of the wrapping and drying stages move in timed sequence through one cell division with each step. The apparatus further comprises axially movable slides or rams for causing the transfer of the cigarette blocks and partially formed packages from one stage of the machinery to the next. The apparatus also includes means for feeding the wrapping paper to the machine and means for folding the wrapping paper about the hollow mandrels of the wrapping drum and folding the ends of the packages closed. The cells of the drum of the top closing device are inclined radially towards one another and the rotation of this drum is controlled such that, after each rotational step, two adjacent cells of the top closing drum are aligned with two adjacent cells of the wrapping drum and two additional adjacent cells of the top closing drum are aligned with a pair of cells of a first drying drum. The top closing drum is rotatable in two cell increments with every second sequential movement of the step drive for the wrapping and drying drums. The sliders which effect the transfer of the packages from the wrapping drum onto the drum of the top closing device and from the top closing device into the first drying drum are respectively operated at every second sequential movement of the step drive whereby packages are transferred in pairs from the mandrels of the wrapping drums into cells of the drum of the top closing device and from the top closing device into a pair of spacially separated cells of the first drying drum. The drying apparatus comprises a further double headed slider mechanism for transferring the packages from cells of the first drying drum to the cells of a second drying drum. The transfer between cells of adjacent, coaxial drying drums occurs simultaneously with the transfer of packages from the top closing device into cells of the first drying drum.

Thus, apparatus in accordance with the present invention may be embodied as a machine for the packaging of cigarettes and comprise a wrapping drum, a top closing drum and a multi-stage drying drum with these drums being axially and radially offset with respect to one another and being rotatable in steps by a step drive. The wrapping drum includes a plurality of hollow mandrels arranged around the periphery of the drum and extending outwardly from the drum for receiving preformed cigarette blocks which, while on the wrapping drum, are partially packaged. The step drive rotates the wrapping drum by increments of one mandrel with each step. The top closing drum has a plurality of cells which are arranged in pairs with the cells of each pair being inclined toward one another in a radial direction such that a pair of adjacent mandrels on the wrapping drum may be aligned with two adjacent cells of the top closing drum to permit the simultaneous transfer of two partially formed packages from the wrapping drum to the top closing drum. While on the top closing drum the second ends of the packages are closed. The step drive rotates the top closing drum in two cells increments at every second step of the drive. The drying apparatus includes a drum which defines at least two spaced coaxial circular arrays of cells. The cells of a first array are arranged so that, when a pair of these cells are aligned with cells on the top closing drum, the thus aligned drying drum cells will be separated by a further pair of cells in the same array. The packages will be transferred in pairs from the adjacent cells of the drums of the top closing apparatus to the separated cells of the first array of the drying apparatus. The step drive rotates the drying apparatus in increments of one cell and a transfer device is provided for transferring packages of cigarettes simultaneously from pairs of simultaneously filled spaced cells in the first array to corresponding cells of the second array of the drying apparatus.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENT

Figure 1:
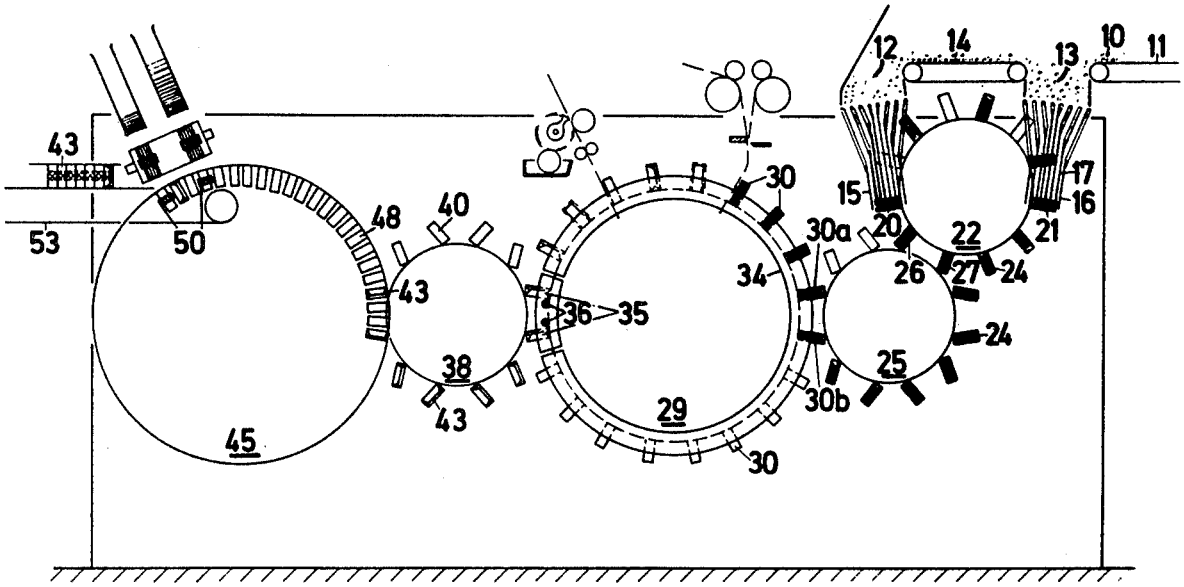
FIG. 1 is a schematic side-elevation view of a packaging machine in accordance with a first embodiment of the present invention.
Figure 2:
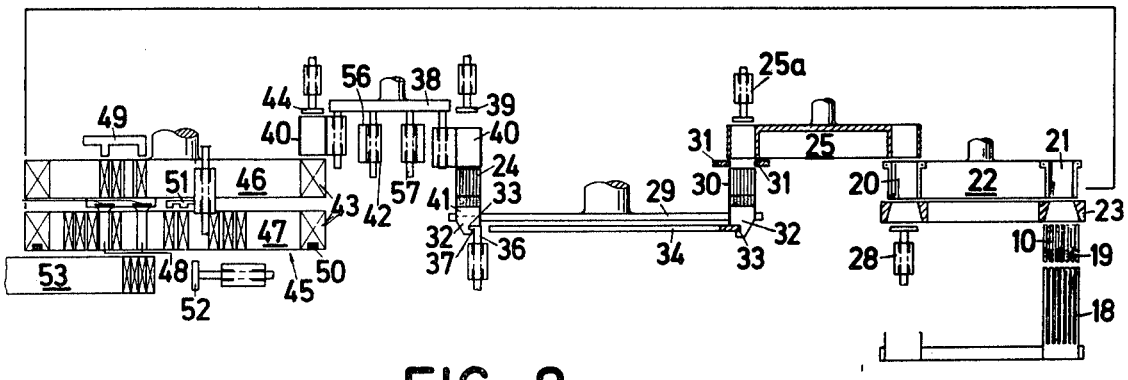
FIG. 2 is a schematic plan view of the machine of FIG. 1.

With reference now to FIGS. 1 and 2, a cigarette packaging machine in accordance with the present invention is shown schematically. The cigarettes 10 to be packaged in this machine are received on a feed belt 11. The cigarettes are delivered to the packaging machine in a direction transverse to their axial length and are conveyed into a pair of hoppers 12 and 13. An auxiliary feed belt 14 assists in the distribution of the cigarettes into the two hoppers. The hoppers 12 and 13 feed directly into chutes 15 and 16 which are provided with plural intermediate walls 17 for the purpose of forming side-by-side rows of superimposed cigarettes. Groups or bundles of cigarettes 10 are discharged from the chutes 15, 16 with the aid of simultaneously operated rams 18 which may best be seen from FIG. 2. The rams 18 preferably engage the filter ends 19 of the cigarettes in the case where filter tip cigarettes are being packaged.

The cigarettes discharged from chutes 15 and 16 are inserted into tubular cells 20, 21 of a block drum 22. The block drum 22 may, for example, have six divisions with each division comprising a pair of cells. In passing from the chutes into the cells, the cigarettes are forced through a restricted opening 23 which urges the cigarettes closer together thus compensating for the removal of the partitions 17 of the chutes. Accordingly, "blocks" 24 comprised of plural cigarettes are formed in the cells 20, 21 of the block drum 22. The block drum is driven, by means of a step drive (not shown), through two cell divisions with each step of motion. Accordingly, after a second complete rotation, all of the cells of drum 22 will be filled with cigarette blocks 24. The fact that some cells are empty after the first revolution of drum 22, on start-up of the machine, may be taken into account in the operation of the wrapping apparatus located downstream of the block drum in the direction of product movement.

In the embodiment depicted there is an even number of cells on block drum 22 between the cells 20 and 21 which, as the apparatus is depicted in FIG. 1, are simultaneously being filled.

The cigarette blocks 24 are transferred from the block drum 22 to a pressing drum 25. The pressing drum 25 will comprise cells 26, 27 in which the cigarette blocks 24 are "trued-up" by pressing. The pressing drum 25 may also include sensing means which insures that each block is complete, such sensing apparatus having been omitted from the drawing in the interest of facilitating understanding of the present invention. The cigarette blocks 24 are transferred from the block drum 22 into the cells of pressing drum 25 by means of a pair of sliders or rams 28, one of which may be seen in FIG. 2. During the transfer the cigarettes are moved in the axial direction from two neighboring full cells of the block drum 22 into two neighboring cells of the pressing drum 25 which are aligned therewith. As in the case of the block drum, the pressing drum is operated in stepwise fashion through two cell divisions.

Figure 3:
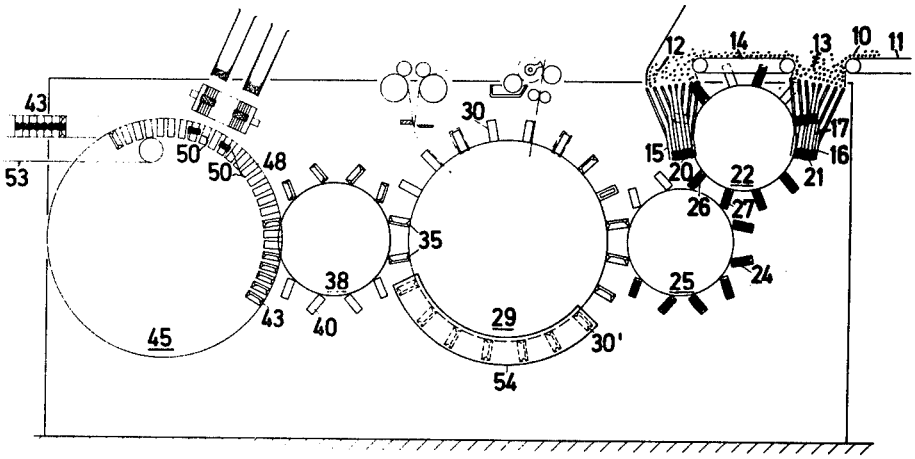
FIG. 3 is a schematic side-elevation view of a packaging machine in accordance with a second embodiment of the present invention.
Figure 4:
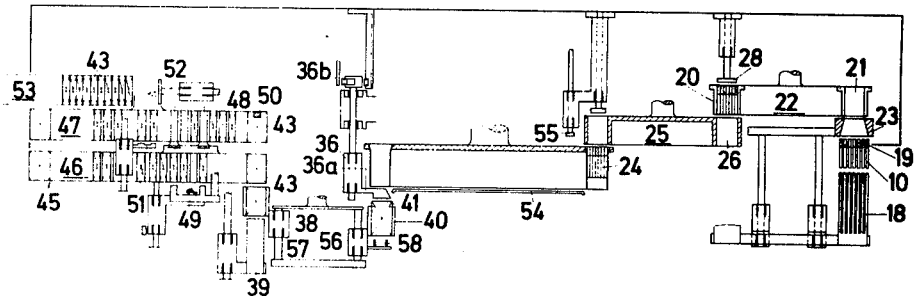
FIG. 4 is a schematic plan view of the machine of FIG. 3.

A wrapping drum 29 is positioned so as to receive the pressed cigarette blocks from drum 25. Wrapping drum 29 comprises a plurality of hollow mandrels 30 which, in the example being described, are twenty in number. The mandrels 30, which may clearly be seen by reference to FIGS. 3 and 4, are open in the axial direction. Mandrels 30 are disposed equidistantly about the circumference of the wrapping drum 29 and are located on radii of the drum as shown in FIG. 1.

The cigarette blocks 24 are transferred simultaneously from two neighboring cells of the pressing drum 25 into two neighboring hollow mandrels **30*a*, 30*b* of wrapping drum 29 by means of a pair of sliders 25*a*. In order to insure that the cells of the pressing drum are axially aligned with the hollow mandrels 30, whereby the transfer of the blocks may occur, the cells of pressing drum 25 are arranged in pairs with the axes of the cells of each pair being inclined toward one another with respect to radii of drum 25 as shown in FIGS. 1 and 3. This inclination corresponds to the relative inclination of adjacent mandrels 30*a*, 30*b*. The cells 20, 21 of the block drum 22 are also arranged so that the inclination of adjacent pairs of cells is the same as the inclination of the pairs of cells 26, 27** of the pressing drum for the same reason.

The wrapping drum 29 is rotated in stepwise fashion in synchronism with the rotation of the other drums of the packaging machine and the double transfer process takes place at every second sequential movement. During transfer the cigarette blocks are guided into the hollow mandrels by means of guide apertures 31.

The packages for the cigarette blocks are formed on the wrapping drum 29 in the manner well known in the art. This may, for example, be accomplished in accordance with the teachings of German Patent No. 920,057. During this process, inner and outer paper webs are drawn from storage reels, as indicated schematically on FIG. 1, and cut to predetermined lengths. Then, after appropriate gluing, the wrapping material is fed to drum 29, a "tube" formed around each mandrel and a first end, hereinafter referred to as the bottom end, of each package folded closed.

The end of each of the hollow mandrels 30 of the wrapping drum 29 which is located opposite to the insertion opening is defined by a slide member 32. These slide members 32 are each provided with a guide notch 33. The guide notches 33 receive a fixed, circular ring 34. The circular ring 34 is interrupted at two adjacent mandrel discharge positions 35 which are aligned with reciprocating fingers 36, the fingers 36 engaging the notches 33 by means of projections 37 when the mandrels are rotated with drum 29 to the discharge positions 35. When the fingers 36 engage the slide members 32, and the fingers are caused to reciprocate, the slide members 32 will act as rams to transfer a pair of neighboring wrapped cigarette blocks 34 onto a drum 38 of a top closing device. In the embodiment disclosed, the top closing drum 38 comprises six divisions, each division consisting of two cells.

The dimensions of the slide members 32, particularly the position of notch 33, are selected such that, upon transfer of a cigarette block from the pressing drum 25 into a mandrel 30 on the wrapping drum 29, first ends of the cigarettes will lie in a plane which is defined by the open insertion end of the mandrels. The second ends of the cigarettes comprising the block will be positioned against a flat surface, i.e., a movable floor, of the slide members 32. Accordingly, after a package has been partially completed by folding the packaging material around the mandrel on the wrapping drum, the cigarette block 24 will offer a support for the folding of the first end or bottom of the package, this first package end being at the insertion end of the hollow mandrel. Accordingly, since there will be no gap between the first formed end of the package and the cigarette block, an impact of cigarettes against the bottom of the package cannot occur as the partly packaged cigarette blocks are moved to the next station in the packaging machine. The embodiment of FIGS. 1 and 2 also employs a follower 39 which aids the transfer of a partly completed package from the wrapping drum 29 into cells 40 of an end or top closing drum 38. The follower device 39 will firmly hold the bottom fold (first formed end) of the package closed during the transfer operation and will thus prevent the package from coming open before the glue has set.

The end or top closing apparatus, as noted above, includes a drum 38 which supports cells 40. These cells 40 are, like the cells of the pressing drum 25, angularly offset with respect to radii of drum 38. The end closing drum 38 is also driven in the same manner and in synchronism with the remainder of the apparatus. The cells 40 are mounted on the drum 38 in an axially slidable manner on guides 57 by means of slides 56. The slides and guides are shown schematically in FIG. 2 and are controlled by means of a cam, not shown. While a pair of neighboring cells 40, into which partially packaged cigarette blocks 24 have been transferred, are still in the transfer position 35, the two receiving cells 40 will be moved backward so that the forwardly extending projecting length 41 of the wrapping material will be out of range and clear of the wrapping drum while the follower device 39 contacts and thus holds the bottom fold of the package firmly. On stepwise operation through two cell divisions at every second sequential movement of the apparatus, the two cells 40 are moved back to the position indicated at 42 and the ends of the packages are closed in the manner known in the art, the apparatus for folding the wrapping material to close the top end of the package having been omitted from the drawing since it does not comprise part of the invention.

The finished packages, indicated at 43 in FIG. 1, are inserted in pairs onto a drying apparatus 45 by means of a double slider or ram 44. The drying apparatus or drum, as may be seen from FIG. 2, consists of a pair of rotors 46, 47 which are axially disposed one behind the other. The rotors 46 and 47 each comprise a plurality of cells which is a multiple of the number of cells supported on drum 38. In the apparatus disclosed, the rotors 46 and 47 comprise sixty aligned cells 48 and during operation the cells are filled by transferring a package from a cell 40 on drum 38 into every third cell of rotor 46, the ram 44 comprising a double slider with a three-cell spacing so that will be two empty cells between two cells into which packages are transferred as shown in FIGS. 1 and 3. The drying drum 45 is always operated stepwise through cell divisions so that all of the cells 48 become filled one after the other.

After the packages 43 have been conveyed by rotor 46 about an arc of almost 360°, the packages are transferred into the cells of rotor 47 by means of a double slider or ram 49. The double slider 49 is, in the disclosed embodiment, displaced from double slider 44 by a space commensurate with three cells 48 so that the transfer between rotors 46 and 47 may occur before the cells return to the loading position where they are in alignment with cells 40 of top closing drum 38. Before this transfer operation is performed, however, a seal is positioned in front of the two packages to be transferred and retained in position by means of suction. When the packages 43 are transferred between the rotors 46 and 47 by means of the double slider 49, the seals 50 become glued to the packages. After the packages provided with the seals, which are indicated at 50, pass through one complete revolution of rotor 47, they are discharged in pairs through the action of a double slider 51 and transferred to a conveyor belt 53 by means of a ram 52.

The double sliders 49 and 51 are driven by the same drive which imparts motion to the double slider type ejection device 44. The use of a dual rotor drying drum 45 insures a long drying time and thus makes the heating of the cells 48 unnecessary. Additionally, the long drying time and the use of a dual rotor drum facilitates the placing of the seals 50 on the packages.

The transfer between the rotors 46 and 47 and the ejection of the packages from rotor 47 is carried out in an out-of-phase manner.

Referring now to FIGS. 3 and 4, a second embodiment of the present invention is depicted. The embodiment of FIGS. 3 and 4 is similar to that described above and thus includes the axially and radially offset drums 22, 25, 29, 38 and 45. The step wise rotation of these drums is accomplished in the same manner as described above.

In the embodiments of FIGS. 3 and 4 a slide plate 54 is positioned so as to extend along the path of movement of the cigarette blocks between the transfer station where the blocks are loaded into the hollow mandrels 30, and the position where the partially completed packages are transferred from the mandrels into the cells 40 carried by drum 38. The cigarette blocks 24 transferred from the pressing drum 25 into the hollow mandrels 30 are, under the action of a ram 55 located at stage 30', inserted to the ends of the mandrels 30 where, together with the slide plate 54, they will form a support for the freshly glued package bottom.

The mandrels 30, in the embodiments of FIGS. 3 and 4, are slotted at their outer radial ends in an axial direction. Accordingly, the discharge of the packages from the mandrels may be accomplished employing a double slider 36 comprising a pair of arms 36*a* which move in the slots. The double slider 36, accordingly, need not be reciprocated during a sequential movement of the apparatus but, rather, can be swiveled out of the mandrels during the next sequential movement of the wrapping drum 29 subsequent to the discharge of the packages. The swivel device for the double slider 36 is indicated schematically at 36*b*.

The cells 40 of the drum 38 of the top closing apparatus are themselves axially movable by means of sliders 56 and are moved out of the range of the double slider 36, as well as the projecting length 41 of the wrapping, which will be folded to form the package top, during transfer of the packages from the wrapping drum mandrels to the top closing device. A pair of nozzles 58 are associated with each of the cells 40 of drum 38 and provide air jets which are directed against the bottoms of the packages during transfer to insure that the package bottoms do not open.

The drying stage of the apparatus of FIGS. 3 and 4 is substantially identical to that described above in the discussion of FIGS. 1 and 2. Thus, the drying apparatus of FIGS. 3 and 4 employs a double-row construction which results in a long drying time and obviates the necessity of additional heating such as, for example, heating the cells of the drum 45. As a consequence of the simultaneous transfer of plural packages from the wrapping stage to the top closing stage, a considerable increase in packaging speed may be obtained. Each array of the drying drum, as explained above, comprises a number of cells which is a multiple of the number of cells in the top closing drum.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. Apparatus for packaging cigarettes comprising:

wrapping means, said wrapping means including a rotatable drum and a plurality of hollow mandrels equally spaced about the periphery thereof, said mandrels being sized to receive preformed blocks of cigarettes, said wrapping means further comprising means for applying a wrapper around the mandrels and folding and gluing the wrapper to form adhesively closed first package ends;

means for closing the second ends of the packages, said second end closing means including a rotary drum having open cells thereon, said second end closing means also including means for folding and gluing the wrappers to define second adhesively closed package ends, the cells of said second end closing means drum being grouped in angularly related pairs, the orientation of the cells comprising each of said pairs being such that the cells of each pair may be simultaneously aligned with a pair of mandrels of said wrapping means drum;

means for drying the glue which retains the first and second package ends in the closed condition, said drying means including at least first and second axially spaced and simultaneously rotatable cell array defining means, the cells of said arrays being greater in number than the cells of the second end closing means drum the angularly off-set orientation of the cells of the second end closing means permitting said second end closing means cells to be brought into alignment with spacially separated cells of said drying means first array;

means for imparting synchronized stepwise movement to said wrapping means and second end crossing means drums and to said drying means cell array defining means, said movement imparting means causing said wrapping means drum and drying means cell array defining means to rotate in increments of one cell division and causing said second end closing means drum to rotate in increments of two cell divisions with every second step of movement of said wrapping means drum;

means for supporting said wrapping means, second end closing means and drying means in partial registration whereby packages partly formed on mandrels in said wrapping means may be transferred into cells of said second end closing means drum and packages may be transferred from said second end closing means drum cells into cells of the first array of said drying means;

first ram means for simultaneously transferring a pair of partially formed cigarette packages from a pair of mandrels on said wrapping means drum into the cells of one of said pairs of cells of said second end closing means drum;

second ram means for simultaneously transferring packages from the cells of one of said pairs of cells of said second end closing means drum into a pair of spacially displaced cells of said drying means first array; and third ram means for transferring packages from a pair of cells of said drying means frist array into a pair of spacially displaced cells of said drying means second array.

2. In apparatus for packaging cigarettes, the apparatus comprising wrapping means including a rotatable drum and a plurality of hollow mandrels supported thereon, the mandrels being sized to receive blocks of cigarettes, the wrapping means also including means for appplying a wrapper around the mandrels and folding the wrappers over the first ends of the mandrels whereby packages having adhesively closed first ends are formed, the apparatus further including means for closing the second ends of the packages, the second end closing means including a rotary drum having an axis and open cells supported thereon which receive the packages with first closed ends from the wrapping means mandrels, the second end closing means including means for folding the packaging material to form adhesively closed second package ends, the apparatus additionally comprising means for drying the adhesive which retains the first and second package ends in the closed condition and means for imparting movement to the wrapping means, second end closing means and drying means, the apparatus also including means for supporting the wrapping means, second end closing means and drying means in partial registration whereby packages partly formed on mandrels in the wrapping means may be transferred into cells of the second end closing means drum and packages may be transferred from the second end closing means drum cells into the drying means, the improvement comprising:

the cells of the second end closing means being arranged in pairs with the cells of each pair being angularly off-set with respect to radii extending from the axis of rotation of the rotary drum on which such cells are supported, the radially inwardly disposed ends of said cells of each pair being closer than the outwardly disposed ends thereof, whereby the adjacent cells of adjacent pairs may be brought into alignment with a pair of adjacent mandrels on the wrapping means rotatable drum;

said drying means including at least first and second simultaneously rotatable cell array defining means, the cells of said arrays being in alignment and being greater in number than the cells of the second end closing means, the angularly off-set orientation of the cells of the second end closing means permitting said second end closing means cells to be brought into alignment with spacially separated cells of said drying means first array;

first ram means for simultaneously transferring packages from an adjacent pair of mandrels on the wrapping means drum into adjacent cells of adjacent pairs of said angularly off-set cells of the second end closing means drum;

second ram means for simultaneously transferring packages from a pair of said angularly off-set cells of the second end closing means drum into a pair of spacially displaced cells of said drying means first array;

third ram means for transferring packages from a pair of cells of said drying means first array into a pair of cells of said drying means second array; and said movement imparting means comprising means for producing synchronized stepwise movement of the wrapping means and second end closing means rotatable drums and said drying means first and second rotatable cell array defining means, the drying means cell array defining means and the wrapping means drum moving in increments of a single cell and the second end closing means drum moving in two cell increments at each second step of movement of the wrapping means drum.

3. The apparatus of claim 2 wherein said third ram means is circumferentially displaced from said second ram means and wherein said ram means each comprise a double slider.

4. The apparatus of claims 2 or 3 wherein said drying means comprises a pair of coaxial cell-defining rotors, the cells of said rotors being aligned with one another.

5. The apparatus of claim 4 further comprising means for applying seals to one end of said packages after the transfer thereof to said drying means.

6. The apparatus of claim 4 further comprising:

means positioned between the two rotors of said drying means for applying seals to one end of said packages prior to the transfer thereof by said third ram means from the cells of the first array to the cells of the second array.

7. The apparatus of claim 4 further comprising:

receiving means for receiving and conveying packages at the end of the drying operation, said receiving means including means for simultaneously ejecting pairs of packages from the cells of said drying means second array.

8. The apparatus of claim 4 wherein the cells of said second end closing means drum are axially displaceable.

9. The apparatus of claim 4 wherein said second end closing means further comprises:

follower means for engaging the first folded ends of the packages during transfer of the packages from said wrapping means to said second end closing means.

10. The apparatus of claim 9 wherein said follower means is movable in synchronism with said first ram means.

11. The apparatus of claim 2 wherein said first ram means comprises slide means positioned in each of said wrapping means drum hollow mandrels, said slide means being axially movable with respect to said mandrels, said slide means defining the effective length of said mandrels whereby the mandrel effective length will be commensurate with the length of the articles being packaged upon the delivery of said articles into the mandrels.

12. The apparatus of claim 11 wherein said first ram means further includes a fixed circular ring which prevents axial movement of said slide means with respect to said mandrels, said ring being interrupted in the unloading position of said wrapping means.

* * * * *